US006758246B2

(12) United States Patent
Weixler et al.

(10) Patent No.: US 6,758,246 B2
(45) Date of Patent: Jul. 6, 2004

(54) WEFT HOLDER DEVICE FOR HOLDING WEFT THREADS ENDS IN AN AIR JET LOOM

(75) Inventors: Andreas Weixler, Lindau (DE); Bernd Voegeli, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 148 days.

(21) Appl. No.: 10/143,527

(22) Filed: May 9, 2002

(65) Prior Publication Data

US 2002/0166599 A1 Nov. 14, 2002

(30) Foreign Application Priority Data

May 10, 2001 (DE) ..... 201 07 885 U

(51) Int. Cl.[7] ..... D03D 47/30
(52) U.S. Cl. ..... 139/194
(58) Field of Search ..... 139/194, 302, 139/430, 435.4, 116.2, 434

(56) References Cited

U.S. PATENT DOCUMENTS 4,936,353 A * 6/1990 Volland et al. ..... 139/194
5,224,521 A 7/1993 De Jager
5,226,458 A * 7/1993 Bamelis ..... 139/194
5,333,651 A * 8/1994 Riezler ..... 139/435.5
5,735,316 A * 4/1998 Hehle ..... 139/194
6,014,990 A 1/2000 Bamelis et al.
6,220,308 B1 4/2001 Speich

FOREIGN PATENT DOCUMENTS

DE 4311918 10/1994
EP 0493847 7/1992

* cited by examiner

*Primary Examiner*—Danny Worrell
(74) *Attorney, Agent, or Firm*—W. F. Fasse; W. G. Fasse

(57) ABSTRACT

A weft holder device holds the free weft thread ends in an air jet loom, using pressurized air and without requiring a suction device. The body of the device has a tapering opening through which the end of the inserted weft thread extends. The opening tapers into a narrower slot in the beat-up and drawing-off direction. An air flow channel communicates downwardly from the slot. Nozzles blow pressurized air downwardly through the slot and into the channel, to pneumatically push the weft thread ends into the channel, so as to hold the weft thread ends from when they are beat-up and bound into the woven cloth and a catch selvage, until the catch selvage is trimmed from the cloth. The weft holder device may be stationarily mounted at a location between a weft detector and a weft tensioner that are connected to the reed so as to move therewith.

22 Claims, 2 Drawing Sheets

WEFT HOLDER DEVICE FOR HOLDING WEFT THREADS ENDS IN AN AIR JET LOOM

PRIORITY CLAIM

This application is based on and claims the priority under 35 U.S.C. §119 of German Utility Model Application 201 07 885, filed on May 10, 2001, the entire disclosure of which is incorporated herein by reference.

FIELD OF THE INVENTION

The invention relates to a device using a flow of air for holding the leading ends of weft threads that have been pneumatically inserted into an open loom shed of an air jet loom.

BACKGROUND INFORMATION

In air jet looms it is generally known to arrange a weft thread holding device in the form of a suction device in the area of or adjacent to a weft tensioning or stretching device at the weft exit side of the loom shed. After a respective weft thread is pneumatically inserted and beat up against the beat-up edge of the woven cloth, the free leading end of this weft thread is pneumatically engaged by the suction of the suction device and then suction-held until the respective weft thread is tightly bound in to the woven web and into at least one catch selvage that is formed along the edge of the woven cloth.

A disadvantage of the known weft holder device embodied as a suction device is that it requires a source of vacuum or suction for developing the required suction for pulling and holding the weft thread end in the holder device. This suction is typically provided by a vacuum unit, or particularly a so-called ring compressor, which provides the required vacuum suction to the suction nozzle of the weft holder device. Such a conventional ring compressor is relatively large and therefore requires a rather large installation space at the side of the weaving loom. Moreover, such a ring compressor adds a considerable additional cost.

SUMMARY OF THE INVENTION

In view of the above, it is an object of the invention to provide a weft holder device for holding the leading ends of weft threads at the downstream or weft exit side of a loom shed, whereby this weft holder device does not require a suction device for its operation. More particularly, it is an object of the invention to provide a weft holder device that can operate with readily available pressurized air rather than requiring a vacuum suction supply. The invention further aims to avoid or overcome the disadvantages of the prior art, and to achieve additional advantages, as apparent from the present specification.

The above objects have been achieved according to the invention in a weft holder device for holding the leading ends of weft threads at a side of an air jet loom, wherein the weft holder device comprises a device body having a pressurized air flow channel therein, and a pressurized air outlet arrangement adapted to introduce pressurized air into the flow channel, so that the leading ends of weft threads inserted into the loom shed and protruding from the exit side thereof are brought into and temporarily held in this flow channel by a flow of pressurized air.

In a particularly preferred arrangement, the device body includes an opening extending through the device body in a direction parallel to the weft insertion direction, whereby the weft thread ends are inserted into this opening as they exit from the side of the loom shed during the weft insertion. The opening has a tapering funnel shape as seen from the loom side or on a vertical section plane extending parallel to the warp threads, whereby the opening tapers into a narrower slot in the beat-up and cloth drawing-off direction. The pressurized air flow channel preferably communicates and extends downwardly from the slot. Thereby, the weft thread ends are first inserted into the opening, then move into the slot as the weft threads are beat-up against the beat-up edge of the woven cloth, and then are pushed down into and held in the pressurized air flow channel by a flow of pressurized air applied by the pressurized air outlet arrangement.

The device body of the weft holder device is preferably arranged stationarily and fixedly relative to the loom machine frame, for example on a cloth spreader or temple. More particularly, the weft holder device may be arranged stationarily at a location between a weft thread detector or stop motion and a weft thread stretching or tensioning device that are each mounted on or connected to the weaving reed, so as to be movable therewith. The funnel shaped, elongated tapering configuration of the opening of the weft holder device, leading and tapering into the narrower slot, allows for the beat-up motion of the weft threads and the drawing-off of the woven cloth, together with the beat-up motion of the weft stop motion and the weft tensioning device. The device body of the weft holder device is arranged in such a manner at the weft exit side of the loom shed so that the pressurized air flow channel extends perpendicularly to the beat-up edge of the woven cloth, and particularly on a plane that is perpendicular to the beat-up edge of the woven cloth.

The weft holder device according to the invention achieves the advantage, that its operation requires only the supply of pressurized air, which is typically already available in an air jet loom. The inventive arrangement completely avoids the need for a ring compressor as well as a suction nozzle in the area of the weft thread stretching or tensioning device, and thus also omits various hoses and the like, which leads to a considerable savings or reduction of cost, space, and complexity.

Additionally, the inventive weft holder device improves the operating characteristics and performance of the loom, because the weft holder device securely holds the loose weft thread ends, and thereby prevents the formation of undesirable loops in the weft thread ends, and the undesirable tucking-in of the weft thread ends back into the cloth selvage.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 3:
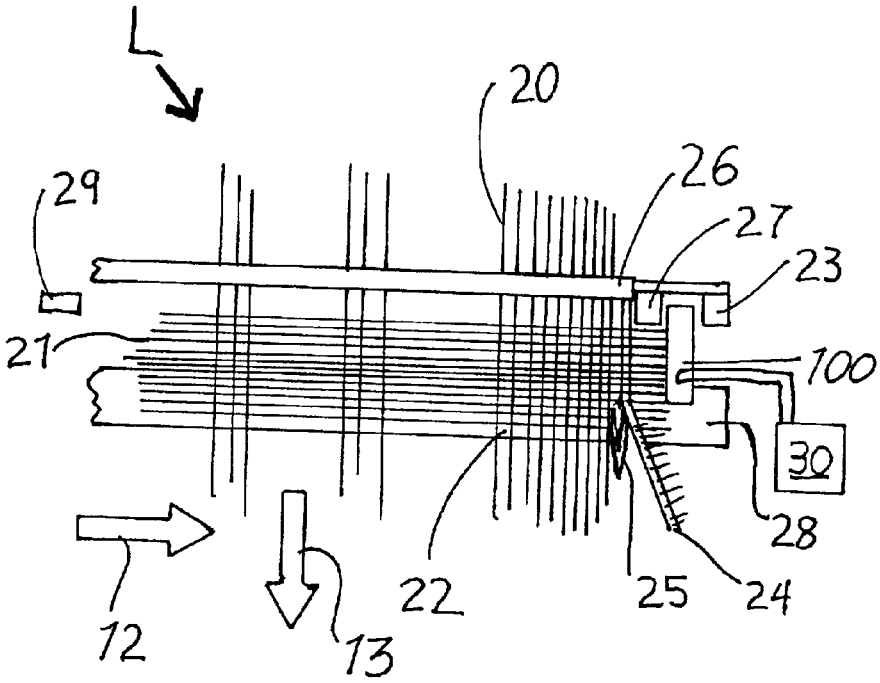
FIG. 3 is a schematic top plan view of a portion of an air jet loom with the inventive weft holder device arranged at the edge of a woven cloth being woven thereon.

FIG. 3 schematically shows a top plan view of the inventive weft holder device 100 arranged at a weft exit side of a loom shed of an air jet loom L. Warp threads 20 extend in a beat-up and cloth drawing-off direction 13, and are formed into successive open sheds by any conventional shedding means (not shown). Successive weft threads 21 are pneumatically inserted by at least one weft insertion nozzle 29 in a weft insertion direction 12 along a weft insertion channel of the weaving reed 26, which then beats-up the successive weft threads 21 against the beat-up edge of the woven cloth 22. A catch selvage 24 is formed by any conventionally known selvage former along the edge of the woven cloth 22, so as to bind-in the free ends of the weft threads under the proper tension. As the woven cloth 22 is drawn off in the direction 13, the catch selvage 24 is later trimmed off of the woven cloth 22 by a weft cutter or scissors 25. Preferably, a weft detector or stop motion 27, as well as a weft stretching or tensioning device 23, are mounted on or connected to the reed 26, so as to move with a beat-up motion together with the reed 26. On the other hand, the inventive weft holder device 100 is preferably arranged stationarily or fixed relative to the loom machine frame, for example being mounted on a stationary base plate of a cloth spreader or temple 28. The weft holder device 100 is connected to a source of pressurized air 30. All of these components are simply schematically illustrated in FIG. 3, but can be embodied according to any conventional teachings.

Figure 1:
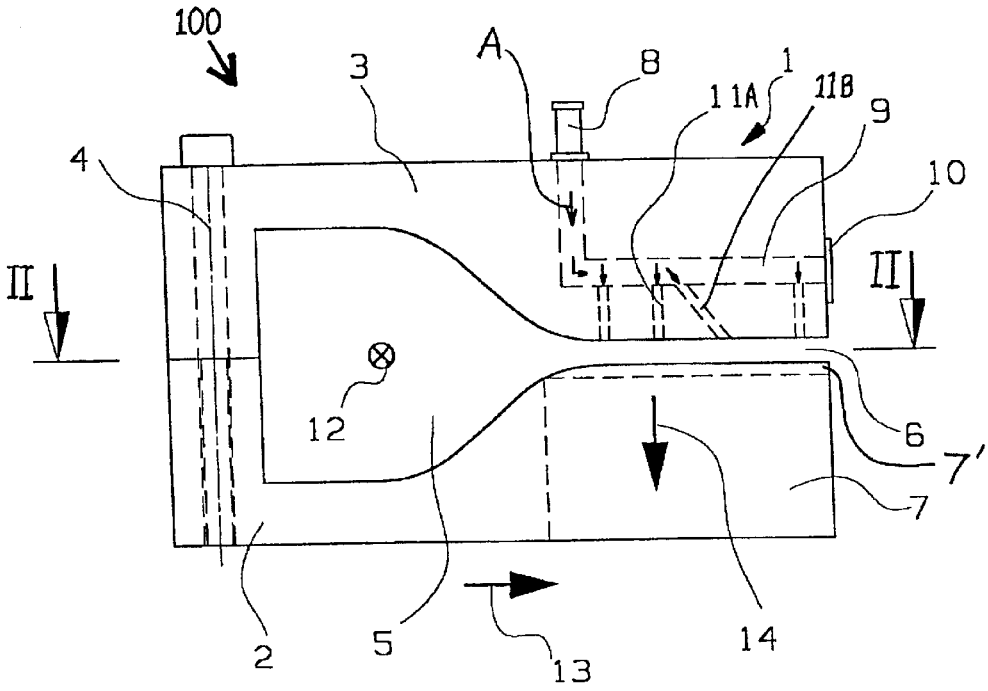
FIG. 1 is a schematic side elevation view of the weft holder device according to the invention, with internal structures show by dashed lines.

FIG. 1 schematically shows a side elevation view of the weft holder device 100, in a view direction corresponding to the weft insertion direction 12, i.e. the direction in which the inserted weft thread travels along the weft insertion channel of the weaving reed 26 of the air jet loom L (FIG. 3) and then exits out of the weft exit side of the weft insertion channel. The weft holder device 100 comprises a substantially quadrangular block-shaped device body 1 including a lower part 2 and an upper part 3, which are connected and held together by a fastener 4, for example a bolt, screw, clamp pin or the like. The two-part construction of the weft holder device 100 is for convenience of manufacturing, installation, and maintenance thereof, but the device body 1 could alternatively be manufactured as a one-piece block.

As further shown in FIG. 1, the device body 1 of the weft holder device 100 has an opening 5 therein, which extends through the device body 1 in the weft insertion direction 12. The weft holder device 100 is positioned at the weft exit side of the loom shed such that the inserted weft threads 21 are inserted with their free leading ends through the opening 5 in the weft insertion direction 12, and then further into the weft stretching or tensioning device 23 (FIG. 3) where the respective weft thread end is first pneumatically entrained and thus stretched or tensioned. As the weft thread is being held in a stretched or tensioned condition in this manner, it is then beat-up in the beat-up direction 13 by the beat-up motion of the weaving reed 26, against the beat-up edge of the woven cloth 22. Through this beat-up motion of the respective inserted weft thread 21, the weft thread, and particularly the protruding end thereof, moves from the opening 5 into a narrowed slot 6 that extends from the opening 5 in the device body 1, which remains stationary. For this purpose, the opening 5 preferably has a smoothly tapering curved funnel-shape as seen in FIG. 1, which tapers in the beat-up direction 13 into the narrower slot 6. The slot 6 extends along a substantially horizontal plane, which is a central plane of symmetry of the opening 5 and the slot 6, between the upper part 3 and the lower part 2 of the device body 1.

Figure 2:
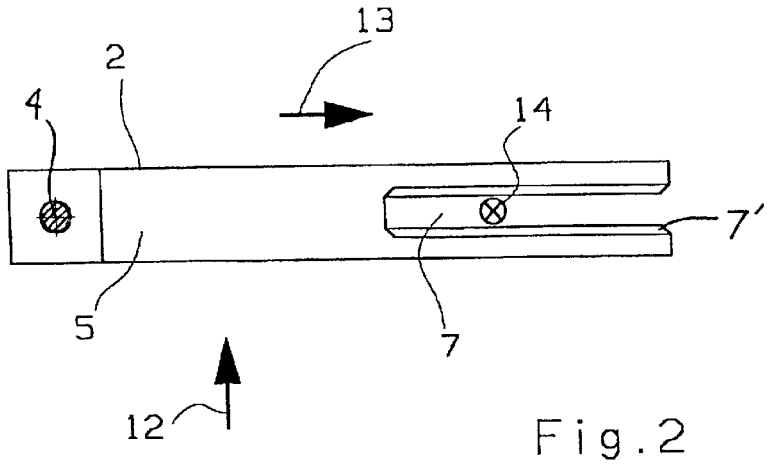
FIG. 2 is a schematic sectional view of the weft holder device according to FIG. 1, taken along the section line II—II in FIG. 1.

As can be seen especially in FIG. 2, and further understood from the dashed lines in FIG. 1, the lower part 2 of the device body 1 has therein a pressurized air flow channel 7 extending downwardly from the slot 6. This flow channel 7 is substantially a slit that opens downwardly in the primary air flow direction 14, and also opens laterally in the beat-up and drawing-off direction 13. More particularly, the air flow channel 7 is substantially a vertically extending slit in the lower part 2 of the device body 1, whereby this air flow channel or slit 7 is open along the bottom edge of the lower part 2 of the device body 1, and along the side or rear edge of the lower part 2 of the device body 1 facing in the drawing-off direction 13. At the top, this air flow channel or slit 7 communicates openly into the narrowed slot 6, preferably with chamfered edges 7' to facilitate a smoother thread handling.

An air distributor channel 9 is provided in the upper part 3 of the device body 1 and connected to a pressurized air connection port 8, to which pressurized air is supplied from the source 30 (FIG. 3). To facilitate manufacturing, the air distributor channel 9 can be formed as a continuous bored hole from the end of the upper part 3 of the device body 1, whereupon this open end of the air distributor channel 9 is closed by a closure 10. Furthermore, the air distributor channel 9 leads and branches off to several blowing nozzles 11, including vertical blowing nozzles 11A and diagonal or obliquely slanting blowing nozzles 11B. Pressurized air A is supplied to the pressurized air connection port 8, and is then distributed through the air distributor channel 9 into the blowing nozzles 11A and 11B, which in turn blow a pressurized air flow in the primary air flow direction 14 into and through the air flow channel 7.

When the weft thread ends have successively moved from the opening 5 into the narrowed slot 6 of the weft holder device 100, the weft thread ends are impinged on and entrained by the pressurized air flow emitted by the blowing nozzles 11A and 11B, whereby the weft thread ends of the several weft threads in the slot 6 are pushed downwardly in the primary air flow direction 14 into and held in the air flow channel 7. Note that the optional obliquely slanting blowing nozzle 11B provides an air flow direction component that is not directly downward in the primary direction 14, but rather exerts an additional pushing force in the beating-up and drawing-off direction 13.

In any event, the pressurized air flow emitted by the blowing nozzles 11A and 11B holds the weft thread ends in the slit or air flow channel 7 as the weft thread ends move along in the drawing-off direction 13, after the respective weft threads have been beat-up and bound-in at the beat-up edge of the woven cloth 22 and bound in to the catch selvage 24. The device 100 preferably continues to hold the weft thread ends until the point at which the weft thread ends and the interconnected catch selvage 24 are trimmed from the edge of the woven cloth 22 by the weft cutter or scissors 25. To allow the weft thread ends ultimately to pass out of the weft holder device 100 in the drawing-off direction 13, the corresponding end of the slot 6 is open in the drawing-off direction 13.

In this manner, the weft thread ends are reliably and consistently held at all stages during the beat-up, binding into the woven web, and binding into the catch selvage, until the catch selvage is trimmed from the finished cloth. This prevents the formation of loops in the weft thread ends and thus prevents the weft thread ends from tucking back into the cloth or the catch selvage. The weft thread ends are smoothly taken-over from the weft stretching or tensioning device 23, for example preferably when the weft stretching or tensioning device 23 releases a respective weft thread 21, as the reed 26 beats back for the insertion of the next weft thread 21 into the next open shed.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In an air jet loom system including warp threads extending downstream in a drawing-off direction, weft threads extending transversely to said warp threads in a weft insertion direction, at least one weft insertion nozzle adapted to insert successive ones of said weft threads in said weft insertion direction through a loom shed formed of said warp threads so that weft thread ends of said weft threads protrude out from a weft exit side of said loom shed, and a reed adapted to beat-up said successive ones of said weft threads in said drawing-off direction against a beat-up edge of a woven cloth being formed of said warp threads and said weft threads, an improvement comprising a weft holder device for holding said weft thread ends, wherein:

said weft holder device is arranged at said weft exit side of said loom shed and comprises a device body, said device body has therein a pressurized air flow channel, a pressurized air outlet arrangement adapted to direct a flow of pressurized air into said pressurized air flow channel so as to bring and temporarily hold said weft thread ends in said pressurized air flow channel, an opening, and a slot that is narrower than said opening, said opening is positioned so that said weft thread ends of said weft threads being inserted by said at least one weft insertion nozzle in said weft insertion direction extend through said opening, and said opening tapers into said slot in said drawing-off direction.

2. The improvement in the air jet loom system according to claim 1, wherein said slot communicates into said pressurized air flow channel.

3. The improvement in the air jet loom system according to claim 2, wherein said slot extends along a horizontal plane and said pressurized air flow channel is a slit that joins and extends from said slot along a vertical plane.

4. The improvement in the air jet loom system according to claim 3, wherein said slit opens outwardly from said device body, respectively through a bottom edge of said device body and through an end edge of said device body facing in said drawing-off direction.

5. The improvement in the air jet loom system according to claim 2, wherein said slot adjoins said pressurized air flow channel with chamfered edges along a junction thereof.

6. The improvement in the air jet loom system according to claim 2, wherein said slot opens outwardly from said device body through an end edge of said device body facing in said drawing-off direction.

7. The improvement in the air jet loom system according to claim 2, wherein said air outlet arrangement comprises air blowing nozzles arranged to blow said flow of pressurized air across said slot and into said pressurized air flow channel.

8. The improvement in the air jet loom system according to claim 7, wherein said nozzles include at least one vertically oriented nozzle and at least one obliquely sloping nozzle.

9. The improvement in the air jet loom system according to claim 1, wherein said device body comprises a first part and a second part that are releasably connected with each other, said pressurized air flow channel is provided in said first part, and said air outlet arrangement is provided in said second part.

10. The improvement in the air jet loom system according to claim 9, wherein said air outlet arrangement comprises a pressurized air connection port, an air distributor channel leading from said port, and plural air blowing nozzles that branch off from said air distributor channel and that are directed into said air flow channel.

11. The improvement in the air jet loom system according to claim 1, wherein said pressurized air flow channel opens out of said device body in a direction of said flow of pressurized air and in said drawing-off direction.

12. The improvement in the air jet loom system according to claim 1, wherein said loom system further includes a weft thread detector connected to said reed at said weft exit side of said loom shed and a weft thread tensioning device connected to said reed at said weft exit side of said loom shed next to said weft thread detector, and wherein said weft holder device is stationarily arranged at a location between said weft thread detector and said weft thread tensioning device.

13. The improvement in the air jet loom system according to claim 12, wherein said loom system further includes a cloth spreader temple, and wherein said weft holder device is stationarily mounted on said cloth spreader temple.

14. A weft thread holder device for holding ends of weft threads in an air jet loom, comprising a device body having therein a pressurized air flow channel, a pressurized air outlet arrangement that is arranged and adapted to direct a flow of pressurized air into said pressurized air flow channel so as to be adapted to bring and temporarily hold the ends of the weft threads in said pressurized air flow channel, an opening, and a slot that is narrower than said opening, wherein said opening is adapted to have the ends of the weft threads inserted therethrough in a first direction, and wherein said opening tapers into said slot in a second direction that is perpendicular to said first direction.

15. The weft thread holder device according to claim 14, wherein said slot communicates into said pressurized air flow channel, with said pressurized air flow channel extending from said slot in a third direction that is orthogonal to said first direction and said second direction.

16. The weft thread holder device according to claim 15, wherein said slot opens outwardly from said device body in said second direction, and said pressurized air flow channel opens outwardly from said device body in said second direction and said third direction.

17. The weft thread holder device according to claim 14, wherein said pressurized air outlet arrangement comprises plural air blowing nozzles that are arranged on a side of said slot opposite said pressurized air flow channel and that are oriented to direct a flow of pressurized air across said slot into said pressurized air flow channel.

18. The weft thread holder device according to claim 17, wherein said pressurized air outlet arrangement further comprises a pressurized air supply connection port, and an air distributor channel leading from said port to said plural air blowing nozzles.

19. The weft thread holder device according to claim 17, wherein said air blowing nozzles include a first nozzle oriented perpendicularly relative to said slot, and a second nozzle oriented sloping obliquely away from said opening relative to said slot.

20. The weft thread holder device according to claim 14, wherein said device body comprises a first part and a second part that are releasably connected with each other, said pressurized air flow channel is provided in said first part, and said air outlet arrangement is provided in said second part.

21. In an air jet loom system including warp threads extending downstream in a drawing-off direction, weft threads extending transversely to said warp threads in a weft insertion direction, at least one weft insertion nozzle adapted to insert successive ones of said weft threads in said weft insertion direction through a loom shed formed of said warp threads so that weft thread ends of said weft threads protrude out from a weft exit side of said loom shed, a reed adapted to beat-up said successive ones of said weft threads in said drawing-off direction against a beat-up edge of a woven cloth being formed of said warp threads and said weft threads, a weft thread detector connected to said reed at said weft exit side of said loom shed, and a weft thread tensioning device connected to said reed at said weft exit side of said loom shed next to said weft thread detector, an improvement comprising, a weft holder device for holding said weft thread ends, wherein said weft holder device is stationarily arranged at said weft exit side of said loom shed at a location between said weft thread detector and said weft thread tensioning device, and wherein said weft holder device comprises a device body having therein a pressurized air flow channel and a pressurized air outlet arrangement adapted to direct a flow of pressurized air into said pressurized air flow channel so as to bring and temporarily hold said weft thread ends in said pressurized air flow channel.

22. The improvement in the air jet loom system according to claim 21, wherein said loom system further includes a cloth spreader temple, and wherein said weft holder device is stationarily mounted on said cloth spreader temple.

* * * * *